US010736419B2

(12) United States Patent
Koulizakis

(10) Patent No.: US 10,736,419 B2
(45) **Date of Patent: *Aug. 11, 2020**

(54) PORTABLE WORK SUPPORT AND KEYBOARD/MOUSE TRAY AND WORK STATION AND TETHERED CHAIR

(71) Applicant: Eugenia Koulizakis, Arlington, VA (US)

(72) Inventor: Eugenia Koulizakis, Arlington, VA (US)

(73) Assignee: Nikki Koulizakis, Sarasota, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/424,115

(22) Filed: Feb. 3, 2017

(65) Prior Publication Data

US 2017/0143117 A1 May 25, 2017

Related U.S. Application Data

(63) Continuation of application No. 14/537,891, filed on Nov. 10, 2014, now Pat. No. 9,596,929.

(51) Int. Cl.
*A47B 83/02* (2006.01)
*A47B 21/03* (2006.01)
(Continued)

(52) U.S. Cl.
CPC ..... *A47B 83/02* (2013.01); *A47B 9/20* (2013.01); *A47B 21/02* (2013.01);
(Continued)

(58) Field of Classification Search
CPC ... A47B 390/02; A47B 23/041; A47B 23/002; A47B 21/0314; A47B 2021/0321;
(Continued)

(56) References Cited

U.S. PATENT DOCUMENTS 4,134,614 A * 1/1979 Fielding, Sr. ..... A47B 83/008 248/118
4,880,270 A * 11/1989 Cooper ..... A47B 21/03 108/20

(Continued)

*Primary Examiner* — Jose V Chen
(74) *Attorney, Agent, or Firm* — Davidson Berquist Jackson and Gowdey, LLP

(57) ABSTRACT

A portable work support device and support for a key board and a pointing device, such as a mouse, for use by occupants of reclining capable office chairs having an adjustable fitted footrest assembly connected to the chair that will provide the seated chair user the ability to achieve a desired pelvis/feet triangulation stabilization effect while reclined by having the seated user's feet placed correctly in an attached footrest thereby producing a tactile input or cue that will lead to the desired muscle or motor output, causing the seated user to actually sit all the way back in the chair, and to be in a posture biomechanically neutral for using and working on the portable work support device, a work station removably housing the portable work support device, and a foot rest assembly to which a chair can be tethered so that a computer user can be properly positioned in a reclining position in the chair and have reduced posture issues when using the work support device while using computer or like equipment.

7 Claims, 16 Drawing Sheets

(51) Int. Cl.

| | |
|---|---|
| ***A47C 16/00*** | (2006.01) |
| ***A47B 23/00*** | (2006.01) |
| ***A47C 7/50*** | (2006.01) |
| ***A47C 7/54*** | (2006.01) |
| ***A47C 7/70*** | (2006.01) |
| ***A47C 7/72*** | (2006.01) |
| ***A47C 16/02*** | (2006.01) |
| ***A47B 9/20*** | (2006.01) |
| ***A47B 21/02*** | (2006.01) |
| ***A47C 1/02*** | (2006.01) |
| ***A47C 7/00*** | (2006.01) |
| ***A47C 7/52*** | (2006.01) |

(52) U.S. Cl.
CPC ..... *A47B 21/0314* (2013.01); *A47B 23/002* (2013.01); *A47C 1/02* (2013.01); *A47C 7/006* (2013.01); *A47C 7/506* (2013.01); *A47C 7/52* (2013.01); *A47C 7/54* (2013.01); *A47C 7/70* (2013.01); *A47C 7/72* (2013.01); *A47C 16/00* (2013.01); *A47C 16/025* (2013.01); *A47B 2021/0321* (2013.01); *A47B 2021/0335* (2013.01); *A47B 2083/025* (2013.01); *A47B 2200/007* (2013.01); *A47B 2200/0023* (2013.01); *A47B 2200/0072* (2013.01)

(58) Field of Classification Search
CPC ..... A47B 2021/0335; A47B 83/02; A47B 2200/0072; A47B 2083/0225; A47B 39/00; A47B 39/02; A47B 2083/025; A47C 16/00
USPC ..... 108/43, 25, 26, 50.01, 50.02; 248/919; 297/188, 170, 217, 346, 423, 429, 135, 297/171, 174, 313, 325, 311, 330, 345, 297/433, 436, 326, 327, 423.46, 423.19, 297/423.24, 423.36, 423.35, 188.01, 297/217.1, 344.1, 423.1, 423.12, 174 R, 297/344.18, 423.86, 423.4
See application file for complete search history.

(56) References Cited

U.S. PATENT DOCUMENTS 4,967,992 A * 11/1990 Menaged ..... A47B 23/044 248/441.1
5,005,702 A * 4/1991 Davis ..... B60N 3/002 108/43
5,081,936 A * 1/1992 Drieling ..... B60N 3/002 108/25
5,134,930 A * 8/1992 Mei-Hwa ..... A47B 23/00 100/42
5,509,844 A * 4/1996 Poirier ..... A63H 33/04 108/25
5,623,869 A * 4/1997 Moss ..... A47B 23/002 108/43
5,732,849 A * 3/1998 Brooks ..... A47G 23/0608 220/17.1
5,909,934 A * 6/1999 McGraw ..... A47B 21/00 297/188.21
6,050,200 A * 4/2000 Sullins ..... A47B 23/002 108/25
6,248,014 B1 * 6/2001 Collier ..... A47B 21/00 454/186
6,270,157 B1 * 8/2001 Kapushinski ..... A47B 83/02 297/170
6,296,408 B1 * 10/2001 Larkin ..... A47B 83/001 400/681
6,374,751 B1 * 4/2002 With ..... A47B 23/002 100/90
6,450,578 B1 * 9/2002 Taggett ..... A47C 1/0347 297/173
6,986,308 B1 * 1/2006 King ..... A47G 23/0608 108/25
7,032,976 B2 * 4/2006 Lin ..... A47C 7/506 297/423.21
7,275,724 B1 * 10/2007 Ward ..... A47B 23/002 108/43
7,823,973 B2 * 11/2010 Dragusin ..... A47C 7/72 108/50.01
7,992,502 B1 * 8/2011 Davis ..... A47B 23/04 108/43
8,051,782 B2 * 11/2011 Nethken ..... A47B 21/02 108/50.01
8,141,949 B2 * 3/2012 Baru ..... A47B 21/00 297/172
8,371,237 B2 * 2/2013 Weber ..... A47B 21/0314 108/102
8,567,808 B2 * 10/2013 Tholkes ..... A61G 5/14 280/47.4
D695,556 S * 12/2013 Nunn ..... D6/707.19
8,939,500 B2 * 1/2015 Voigt ..... A47B 83/02 297/170
9,220,348 B2 * 12/2015 Stieler ..... A47C 7/68
9,433,288 B2 * 9/2016 Voigt ..... A47B 83/02
9,554,966 B2 * 1/2017 Kuro ..... A61H 1/0274
2004/0261668 A1 * 12/2004 Jarke ..... B82Y 30/00 108/43
2010/0201165 A1 * 8/2010 Dankovich ..... A47B 83/001 297/135
2011/0031788 A1 * 2/2011 Kosik ..... A47C 3/0257 297/217.3
2011/0075337 A1 * 3/2011 Riley ..... A47B 21/0073 361/679.2
2012/0060724 A1 * 3/2012 Doss ..... G06F 1/1632 108/43
2013/0061781 A1 * 3/2013 Wong ..... B60N 3/002 108/3
2013/0147716 A1 * 6/2013 Hawker ..... G06F 1/1632 345/168

* cited by examiner

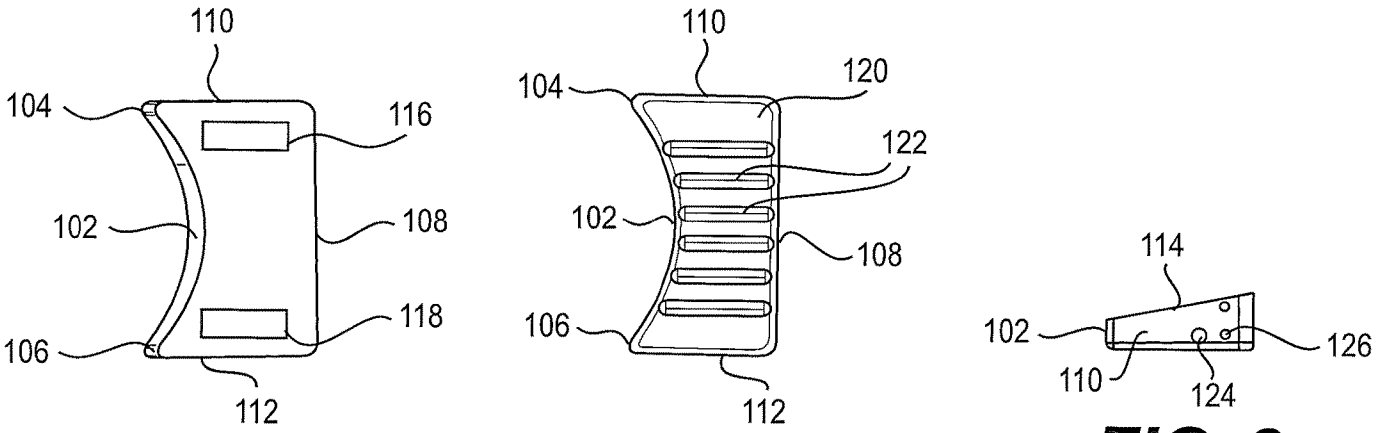
FIG. 6
FIG. 7
FIG. 8
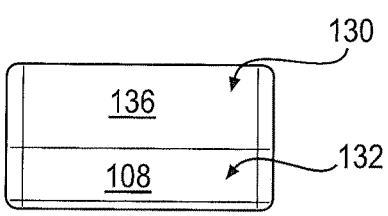
FIG. 10
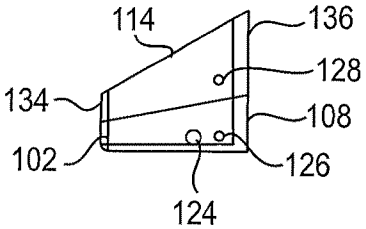
FIG. 9

PORTABLE WORK SUPPORT AND KEYBOARD/MOUSE TRAY AND WORK STATION AND TETHERED CHAIR

CROSS-REFERENCE TO RELATED APPLICATION

This application is a continuation of U.S. patent application Ser. No. 14/537,891, filed Nov. 10, 2014, now U.S. Pat. No. 9,596,929.

COPYRIGHT NOTICE

A portion of the disclosure of this patent document contains material which is subject to copyright or mask work protection. The copyright or mask work owner has no objection to the facsimile reproduction by anyone of the patent document or the patent disclosure, as it appears in the Patent and Trademark Office patent file or records, but otherwise reserves all copyright or mask work rights whatsoever.

FIELD OF THE DISCLOSURE

This disclosure relates to furniture and in particular to a work support device and keyboard and mouse tray that is portable yet useful by users of chairs for either work or home environments, and specifically when using chairs that will force a chair user or occupant to sit back in the seat and to be in a reclined position by supporting and thereby controlling the position of the seat user's feet and legs relative to the seat pan and base to achieve a stable seated posture while working on a variety of computer platforms including, but not limited to, desktops, laptops, netbooks, tablet and smart phones.

INTRODUCTION

Many attempts have been made over time to create devices that can be used by seated users of seats that recline yet force the seated user to sit all the way back in the seat. The present invention provides a portable work support and keyboard and mouse tray that is multi-positional and thus able to be oriented in one of a number of positions making its use by such a seated user a comfortable and rewarding experience.

As for chairs and foot rests, Larson, in U.S. Pat. No. 6,196,631, sets forth a variety of chair styles, including bench, Grandjean, Balan, Mandel, center-tilt and knee-tilt. He also noted that there were six footrest designs including horizontal rings, center column supported rings or rests, horizontal bars supported by the chair sear pan, chair spoke supports, separate floor mounted supports, and the floor itself. Thus, included among these six have been those in the form of separate footrests that are not at all part of or connected to the chair, but rather rest on the floor or another structure. Others have been built into the base as a ring or foot support that is relatively close to the floor on which the chair is resting. Others, as with salon chairs, have provided a foot rest that is adjusted by a handle to provide a foot rest that can move between a retracted position and an extended position, but not with the objective of having the seated person sit back in the chair, and not in a reclined position. Some have fixed a footrest with the seat itself or the seat pan so as to move in unison therewith (see, Cooper, U.S. Pat. No. 5,056,864). Still others have been provided for high chair seats by having a fixed footrest attached to the seat bottom, (van Hekken, U.S. Pat. No. 5,011,227), or to the central seat post. It is important to note that if one's feet are placed correctly in a footrest that is itself correctly located on a chair's structures, then the placing of a users feet in a footrest will create a tactile input/cue that will lead to the desired (muscle) motor output and achieve the desired result of having the seated user sit all the way back in the chair.

While there have been many attempts at creating an environment for achieving a desired seated user position, those have not been specifically directed to the objective of getting the seated user sitting fully into the chair, and thereby actually use and obtain the benefit of a chair's design on the seated posture of the user, as well as optimizing seated posture while interacting with a computer. While some of the prior attempts have sought to provide user comfort, to position the user into a more neutral posture, or to position a seated occupant in a more equitable weight distribution position within the chair, they have not attempted to make adjustability specific to the desired end result of making that seated user to sit all the way back in the chair and then to have that user remain all the way back in the chair while in a reclined position while interacting with a computer. There has been some adjustability, but only to provide comfort for the user and not specifically designed to provide a way to fit each of a wide range of individuals, and to facilitate the seated user actually taking advantage of the chair's design and structure and, as just noted, to sit all the way back in the chair every time and throughout the period of use while the user is in the chair and is using a computer.

As previously noted, the invention relates generally to field of furniture and more specifically to an ergonomic chair and associated structure, as well as an aftermarket support structure, that optimizes musculoskeletal energy efficiency, reduces muscle fatigue and decreases low back pain of a seated individual and when properly positioned in an ergonomic chair.

There is now a 23 billion dollar a year office manufacturing industry in the United States. Included within the sales by that industry is seating equipment, which includes ergonomic desk chairs, which is expected to make up the largest product segment for the industry. In the five years to 2013, this specific segment's share of revenue has increased to 33.1% fueled by growing concerns about health and safety in the office stemming from the prolonged periods of time users are spending seated while working on computers. The time and financial cost of the neck, back and upper extremity pain of the typical office worker, as well as other musculoskeletal disorders (MSD's) principally stemming from prolonged inefficient sitting postures while using a computer, has risen to epidemic proportions. Chronic low back pain disability is the single most expensive benign condition that is medically treated in industrial countries, costing the health care system more than $65 billion a year. Back pain is also the number one cause of disability in people under the age of 45, is the third leading cause of disability in people over the age of 45, and comprises approximately 40% of all compensation claims made in the United States. Current medical studies suggest that back pain will affect more than 80% of the population at some point in their life. With the rapid development of modern technology, sitting at a computer, at work and home, has now become the most common position assumed by most people in today's industrialized nations. And the connection between pain and prolonged sitting in office chairs, even "ergonomic" ones, is well documented. (Li G, Haslegrave C M. Seated postures for manual, visual and combined tasks. Ergonomics. 1999 August; 42(8):1060-86.).

The term "ergonomic" first entered the modern lexicon when Wojciech Jastrzebowski used the word in his 1857 article "The Outline of Ergonomics; The Science of Work, Based on the Truths Taken from the Natural Science".

In the late 1970's, the study of human-computer interaction (HCI) was born, involving the study, planning, and design of the interaction between people (users) and computers. Attention to human-machine interaction became important because poorly designed human-machine interfaces began to lead to many unexpected problems, including an epidemic of low back pain and other MSD's, even before users spent as many hours per day working on computers as they do now. Today, the word "ergonomic" design has come to mean the applied science of equipment and workplace design intended to maximize productivity and efficiency by reducing operator fatigue and discomfort.

Over the last two decades, one focus of ergonomic office chair design research has shifted from identifying the best single sitting posture, towards a more dynamic view of sitting and movement, in an effort to keep the user in motion, even while seated. While the emphasis on movement has helped avoid some ergonomic risk factors related to inefficient prolonged sitting without breaks, it also confuses the issues. While movement is critical for the health of the user's musculoskeletal, skin, and cardiovascular systems while seated, not all movements and postural adjustments are equally beneficial, with some movements far more detrimental than others. Taken to extremes, a strict emphasis on seated movement can introduced new risk factors for the sedentary, mainly the persistence of chair operator error (underutilization of the chair's ergonomic benefits), along with some form of MSD symptom development for nearly every consumer of this product. A 2012 systematic research study looking at assessing the effects of dynamic sitting on trunk muscle activation found that dynamic sitting did not significantly change trunk muscle activation in any of the studies reviewed. Major chair manufacturers OFM's now advocate for movement away from the chair while working, including standing, walking, taking frequent breaks, even using a standing or treadmill desk, to break the cumulative repetitive trauma that originates from sitting incorrectly for prolonged periods, mostly stemming from operator error. In this regard, operator error means seating mistakes by a chair user. However, research shows that not sitting or standing, alone, is not a panacea solution to decreasing MSD's and low back pain ("LBP") for computer users. Standing for prolonged periods may introduce a host of other MSD's stemming from poor standing posture, provoking accelerated rates of degenerative musculoskeletal overuse conditions, particularly in the low back and knees, for many who attempt to work at a computer standing instead of sitting. Sitting requires far less energy expenditure than standing overall, deeming it a more ergonomic position for prolonged computer work. Thus, an ergonomic computer work station designed to reduce the frequency and duration of operator error while seated is needed and is achieved by the present invention.

For the purpose of studying the seated human body at work, ergonomists, medical personal and manufacturers have identified three possible user postures based on the location of the body's center of mass (COM) over the body's base of support (BOS), as are shown in FIG. 23. These 3 possible postures are shown below: reclining (COM posterior to the pelvis), upright (COM plumb with the pelvis), and forward leaning (COM forward of the pelvis).

Multiple studies over the last 50 years have shown that reclining seated posture is the most ergonomic, with back extensor activity and intervertebral disk pressure significantly lower, especially when the user's natural anterior lumbar curvature (lumbar lordosis) is supported, and the pelvis is stabilized in a neutral position. The pelvis is best stabilized by its being tightly wedged into the seat back/seat pan junction in the chair proximally, and by both feet firmly planted on the floor or on an angled platform, thereby creating a triangulated stabilization effect for the user's lumbo-pelvic region.

Forward leaning posture is the least ergonomic of the three postures and, therefore, the most physiologically detrimental, with upright posture coming in a close second. "Edge sitting", often coupled with the presence of a sustained rounding of the low back known as "posterior lumbar curvature" (lumbar kyphosis), is one of the most common and detrimental of chair operator errors. It describes how a user is sitting when their pelvis is not all the way back in their chair, and the torso is unsupported, thereby underutilizing one of the most important benefits that today's ergonomic chairs can offer, lumbo-pelvic stabilization. A user can make attempts to maintain their neutral lumbar lordosis while edge-sitting, but studies have shown that most users who attempt to sit upright without a back support in a conventional ergonomic chair inevitably succumb to forward leaning and eventual sustained kyphotic posture. Studies have also shown that sustained and/or repetitive lumbar kyphosis when seated causes creep of the viscoelastic tissues of the lumbar spine, as well as accelerated hip flexor and hamstring muscle tightness. This can result in immediate and residual laxity of the lumbar joints, and an over stretch of the facet joint capsules, both of which are contributing factors to the biomechanical destabilization of a user's lumbar spine, and the resultant onset of spine degenerative disorders such as stenosis and arthritis, and potentially chronic LBP.

Other studies have shown that maintaining a reclined position, with the lumbar lordosis supported and the pelvis being in neutral condition, in conjunction with the placement of technology (monitors, keyboards, etc.) at appropriate proximities to the user, is the most physiologically efficient position for a user while seated in an ergonomic chair and interfacing with a computer. Accordingly, many of today's ergonomic chairs incorporate lumbar and pelvic support features in the seat back and seat pan, as well as seat tilting mechanisms and tilt locks, designed to encourage a user to sit all the way back in their seat for prolonged periods, in recline, in order to best utilize the benefits of the chair's design. Despite these significant advantages, many if not most chair users do not sit in a reclined position and most usually this is due to operator error that is permitted by the chair's design itself in combination with poor placement of technology relative to a user.

LP Stabilization Via LPF Triangulation

The inclination in present cultures is to look at the body as if it was constructed solely by means of compression. We tend to think of the skeleton as another version of the stone wall with the bones stacked one on top of the other, each relying on the ones below. LPF (lumbopelvic-feet) triangulation redirects the forces to the ground via the legs and feet, thereby immediately reducing the compression forces through the LP region. For a seated individual without the support of one's legs, that user's super-incumbent weight is transferred to the LP region and to the seat pan only, which in turn endure higher, chronic compression forces that could otherwise be diverted away from the LP region through simple LPF triangulation.

Since most chair-use related LP MSD's (muscle-skeletal disorders) are a consequence of cumulative compression forces over time, then a work station system that could effect more frequent LPF triangulation would serve to significantly reduce compression forces at the LP region for high frequency/duration computer users. It would certainly help decelerate LP region MSD onset, depending on the frequency of: (1) the occurrence of LPF triangulation; (2) backrest angles averaging 25 degrees posterior to vertical, and (3) the appropriate positioning of a monitor, keyboard and a pointing device. Both would further divert user weight off seat pan and LP region and onto seat back. If the chair back angle is more than 30 degrees posterior to vertical, then the benefits of a reclined angle of a computer user are trumped by the disadvantages of a poor position, including too much resultant flexion in the neck to maintain eye contact with a computer screen, and a decrease of oxygen intake, causing user sleepiness, as a result of increased gravity on the lungs reducing lung expansion during inhalation. As noted, the present invention involving the chair base helps the seated user to do all three more often.

With the foregoing in mind one can then say that:

> "optimal lp stabilization=mechanical triangulation+ tensegrity."

However, this view of body as an inert load, and how best to stabilize it by a reduction in gravity-related compression forces is only half accurate. The human body actually uses both compression and tension in a manner known as "tensegrity."

Tensegrity is a term coined by architect Buckminster Fuller in 1929 when he combined the words "tension" and "integrity" to describe structures whose integrity rely on local, discontinuous compression members (for us, humans, our bones) floating in a sea of continuous tension (muscles and connective tissue). A human's primary connective tissues include muscles, tendons, ligaments, joint capsule tissues and, in the spine, intravertebral discs. The bones push outward against soft tissues that pull in. Bones resist compression and soft tissues resist tension.

In the world of physical therapy, this concurrent tensing of the muscles around the joints of a fixed limb is described as a CKC (closed kinetic chain) muscle activation. CKC muscle activation around the LP joints decompresses and stabilizes the region by placing all the soft tissue around these central skeletal joints in tension at once. One can imagine the mechanism of muscle tension-induced LP decompression that can happen in a seated, or standing person. This is also the mechanism of LP decompression that occurs when a human does a handstand or a cartwheel using the arms as the support structures instead of the legs.

In 1955, Dr. Arthur Steindler, an orthopedic surgeon, described an analysis of human movement. Dr. Steindler suggested that the extremities should be viewed as a series of rigid, overlapping segments and defined the kinetic chain as a "combination of several successively arranged joints constituting a complex motor unit." Dr. Steindler defined closed kinetic chain exercise as a condition or environment in which the distal segment of a human limb meets considerable external resistance (as is the case with the footrest of this invention) that restrains movement. In a CKC movement, the distal end of the extremity is fixed, emphasizing joint compression along the joints within the kinetic chain and, in turn, stabilizing the joints by diverting the compression away from the joints and onto the tension tissues surrounding the joints, instead. This is the mechanism of leg muscle activation while seated in a chair pushing against a fixed surface (e.g., a properly attached foot rest).

The Angles Issue:

The only angle that really matters for a seated individual is the backrest angle, but for the seated individual using a computer, angles of the neck, shoulder, elbows and wrists matter as well.

As long as a seated chair user is comfortable, and can place their feet comfortably onto the footrest platform of this invention, so as to not cause a posterior rotation at their pelvis, or a rounding of the low back, then there will be better control over and a better relationship developed between desired hip, knee and ankle angles. In addition, the longer one activates the leg's anti-gravity muscles while using the present invention by pushing against the securely attached foot rest platform or plate then one collateral benefit of doing such leg muscle activation using the present invention is to achieve the benefit of less tightness in the seated user's hip flexors and hamstrings by virtue of a chronic activation of both muscle groups' antagonist muscles (glute max and quads, respectively) on a fairly frequent basis. A necessary consequence of muscle activation is antagonist muscle relaxation (called pull-counter pull).

Both upright and forward leaning positions will be considered herein collectively as awkward postures. Both have been shown to accelerate pathological MSD processes as compared to reclined positions. People performing computer related tasks in either an office, home, hotel, café or other environments continue to exhibit one or both of these awkward postures throughout most of their work day. The cause of such awkward postures is due to operator error and is most usually being triggered by the instinctive or subconscious and involuntary need of the seated user to view their computer screen, and to type on a poorly located keyboard and pointing device, even if the resultant posture was awkward.

A human's capacity to maintain balance is defined as the ability to maintain the body's COM over its BOS. To maintain balance, a properly functioning human balance system offers the brain three forms of sensory input to integrate before generating a subconscious, instinctive postural adjustment, also known as a "balance reaction" or a "motor output". The three sensory inputs our bodies provide are (1) visual input, (2) vestibular input, and (3) proprioceptive input. Visual input, collected in the eyes, tells our brains what we see, or want to see. Vestibular input, gathered at our vestibular organs located between our ears, relays information related to sound, rotation, linear movement, and equilibrium. Proprioceptive input, gathered from pressure and stretch receptors in the skin, muscles and tendons, provides the brain information regarding the body's position in space. Together, these three sensory inputs gather information for us to examine before our brain generates an instinctual postural adjustment with the end goal of maintaining one's COM over its BOS. There is no better example of sensory input leading to an intuitive balance reaction than when one trips over something while walking, thereby triggering a swift, instinctual, and awkward postural adjustment!

If, for whatever reason, one or more sensory system's capacity to provide input is limited, then the brain will make motor output decisions without the benefit of the missing input's data. In other words, the brain will generate postural adjustments based only on the sensory input actually being provided. If an office chair does not provide a consistent means for the seated occupant's feet, and the associated legs, to provide proprioceptive input to the brain, then the brain will rely mainly on visual and vestibular data in triggering a postural adjustment in achieving the user's goal of looking at their computer's screen. And, if one's COM is already close to being positioned above the pelvis or anterior to it relative to vertical, then an instinctive migration to an unhealthy posture is triggered, and another is not triggered until the user senses musculoskeletal discomfort, or conscious override. Thus, it may seem like the eyes always win, but that is only because the critically important proprioceptive sensory input from the user's feet and ankles are not always in the game. A significant design malfunction of every ergonomic office chair is that the triggering of operator error, and the resulting poor sitting posture, is not primarily due to the location of the computer screen being viewed, but rather due to the lack of continual sensory input from the feet and ankles to help each seated user reduce their frequency of instinctive migration to awkward postures.

The present invention provides this desired sensory input from the feet and ankles on a continuous basis. It minimizes operator error, it increases the frequency of healthier instinctive postural reactions by supplying the sitter's brain with a far greater amount of lower extremity proprioceptive input to consider, on a consistent and on-going basis while seated, and it allows increased use of the lower extremity muscles. Collectively, this reduces the inefficient overuse of back extensors and upper extremity muscles. In addition, the present invention widens the BOS surface area to include the feet, therefore reducing PSI through the back, buttocks, and thighs. It also reduces compressive loads through the lumbar spine, thereby facilitating reduced rates of spinal shrinkage. Further, it decreases sustained and/or repetitive lumbar kyphosis, therefore reduces pathological creep of the viscoelastic tissues of the lumbar spine, and it decreases hip flexor and hamstring muscle tightness accelerated by sustained and/or repetitive lumbar kyphosis. Finally, the present invention can be used as a therapeutic intervention, as part of a greater plan of care, in the medical treatment of patients with signs and symptoms of prolonged inefficient posture related MSD's. When used in conjunction with adjustable technology for holding equipment, such as a monitor, a keyboard and mouse, the present chair and foot support invention, or the aftermarket foot support assembly in conjunction with the keyboard tray or work support, permits a seated individual to be placed in a desirable reclined tilt angle between 10 and 45 degrees from vertical, dictated by user preference and proximity of technology, that will optimize energy, reduce muscle fatigue, decrease lower back pain, and render the work place much more inviting.

From an ergonomic viewpoint, of a seated chair user, the user's two feet and pelvis is what triangulates stability. A major part of maintaining such stability, especially in the desired reclined position, and to help avoid operator error and awkward seating positions, is to provide stability for the user's feet. When a computer user's pelvis is supported using the legs, knees and ankles and feet, it is impossible to slouch unless he technology is misplaced.

The present invention also permits a seated user to sit fully back in the chair, thereby increasing the time a user actually sits all the way back in their chair and thus enables the seated user and one's back to fully benefit from the chair's design and to achieve the desired seated posture.

Another and equally important feature of the present invention is that once fitted and positioned to an individual's anthropometric needs, that is achieving the desired reclined position relative to the work environment including the seated user's leg length, the desk's height, the monitor's height, and so on, the pelvis/foot triangulation stabilization effect for that seated user will be maintained, even in recline. This triangulation in recline approach completely prevents the sitter from slouching for sustained periods and eliminates the foregoing operator error occurrences and awkward positions.

As noted, it is important for the present invention that a seated user be in a reclined position for chair use, whether in a home or office environment. When most people recline, depending on their height and their chair's tilting mechanism, their feet come off the floor. At that point the feet/pelvis stabilization triangle is disrupted, and that person is no longer experiencing all the chair's benefits. When one's feet dangle, one intuitively sits back up (and usually forward of vertical) in order to re-attach their feet to a solid surface, sacrificing the contact their back makes with the chair, causing the "edge-sitting."

For shorter people, the off-loading of their feet occurs earlier in the recline process. For taller people, this happens with greater degrees of recline. If a tall person's hip flexors or hamstrings are tight, then a deep recline will be uncomfortable in the low back, even if their feet are technically still on the floor. Tight hip flexor and hamstrings promote lumbar bending with recline, rather than "hips opening up," which will cause a tall person to sit back up just as quickly. So a tall person, too, needs to be able to recline with their feet position also under control to thereby allow them to also stay all the way back in their chair, in work recline, and be able to remain that position for longer periods of time.

DESCRIPTION OF PRESENTLY PREFERRED EXAMPLES OF THE INVENTION

Brief Description of Figures

The invention is better understood by reading the following detailed description with reference to the accompanying drawings in which:

FIG. 6 shows a top plan view of a positioning pillow for the work support device;

FIG. 7 is a bottom plan view of the positioning pillow of FIG. 6;

FIG. 8 is a side elevational view of the positioning pillow of FIG. 6;

FIG. 9 is a side elevational view of an inflated positioning pillow;

FIG. 10 is a front elevational view of the inflated positioning pillow as in FIG. 9;

DETAILED DESCRIPTION OF PREFERRED EMBODIMENTS

A. Overview

Figure 1:
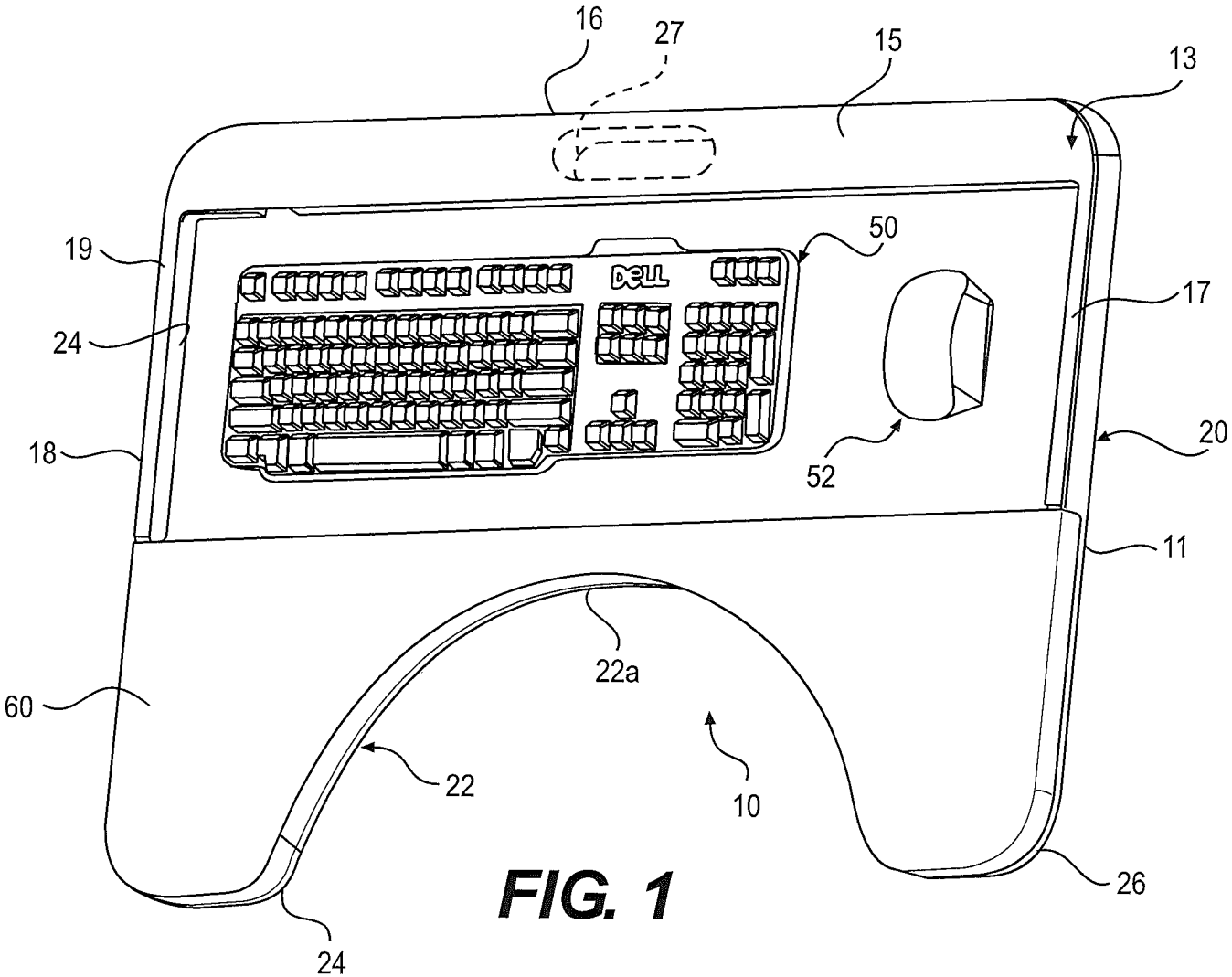
FIG. 1 is a perspective view of a portable work support and for supporting a key board and mouse, according to the present invention.

To gain a better understanding of the invention, preferred embodiments will now be described in detail. Frequent reference will be made to the drawings. Reference numerals or letters will be used throughout to indicate certain parts or locations in the drawings. The same reference numerals or letters will be used to indicate the same parts and locations throughout the drawings, unless otherwise indicated.

B. Environment

The embodiments hereafter being described will be with respect to an office work environment, or to any work environment where a user will be seated in a chair and interacting with a computer of any form, including, for example, but not limited to a desk top computer, laptops, netbooks, tablets, ipods, ipads, smart phones and/or hand held devices, and it should be understood that the present invention applies equally well to chairs designed for home, outdoor or other environments. The scale of the embodiment, therefore, is to be understood with respect to this type of article and these types of work environments. It is to be understood as well, however, that the invention is applicable to other articles and its scale can vary accordingly.

C. Structure

Turning now to FIGS. 1-3 and 14-16, a work support device according to the present invention is shown generally at 10 can be comprised of a base layer 11, having a top surface 12 and a bottom surface 14. A separate raised U-shape raised member 13 is attached to the top surface 12, for example, mechanically or by a suitable adhesive. Raised member 13 includes an upper portion 15 outer side members 17 and 19. Together with base 11 define the raised members 15, 17 and 19 define a top or distal edge 16 and right and left side edges 18 and 20, respectively. The base 11 also has a front or proximal edge 22, which is preferably shaped as a curved area 22*a*, that is bounded by two outwardly extending projections 24 and 26. The work support can also be provided with an integral handle 27 positioned centrally along the distal edge.

Figure 14:
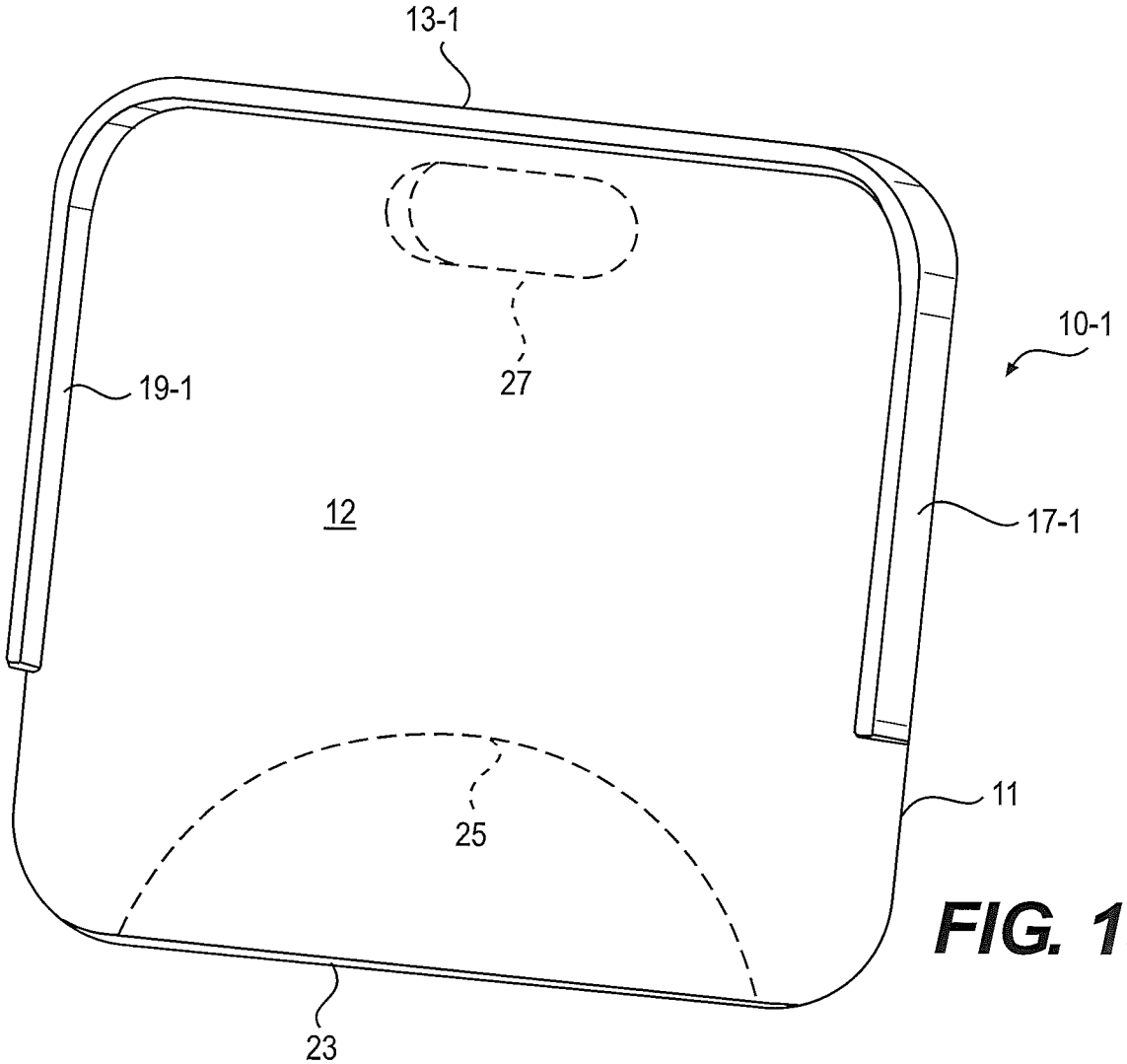
FIG. 14 is a perspective of a work support or tray without a liner in place.

FIG. 14 shows a modified tray 10-1 having a slightly different raised member with the top portion 13-1 being narrower than is 13 in FIG. 1. In FIG. 14 the proximal edge 23 is shown as being straight across, but could also have a curves edge as shown by the dashed line 25. The raised portion in FIG. 14 also includes the outer side members 17-1 and 19-1. The work supports or trays 10 or 10-1 could also be provided with an integral handle in the form of an opening 27 through base 11 as is shown in dashed lines in FIG. 14.

Figure 2:
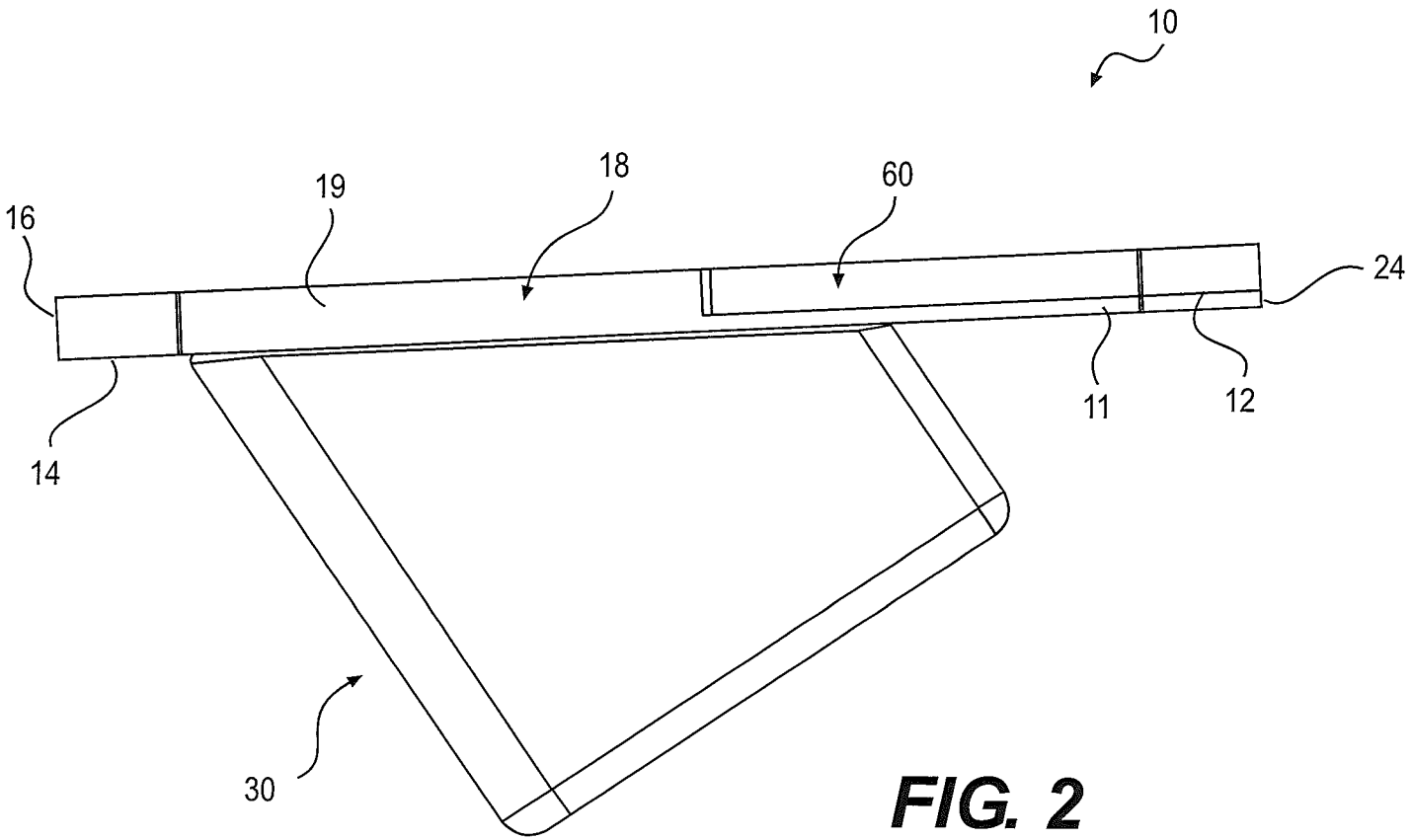
FIG. 2 is a side elevational view of the work support of FIG. 1 showing a fully inflated bottom support.
Figure 3:
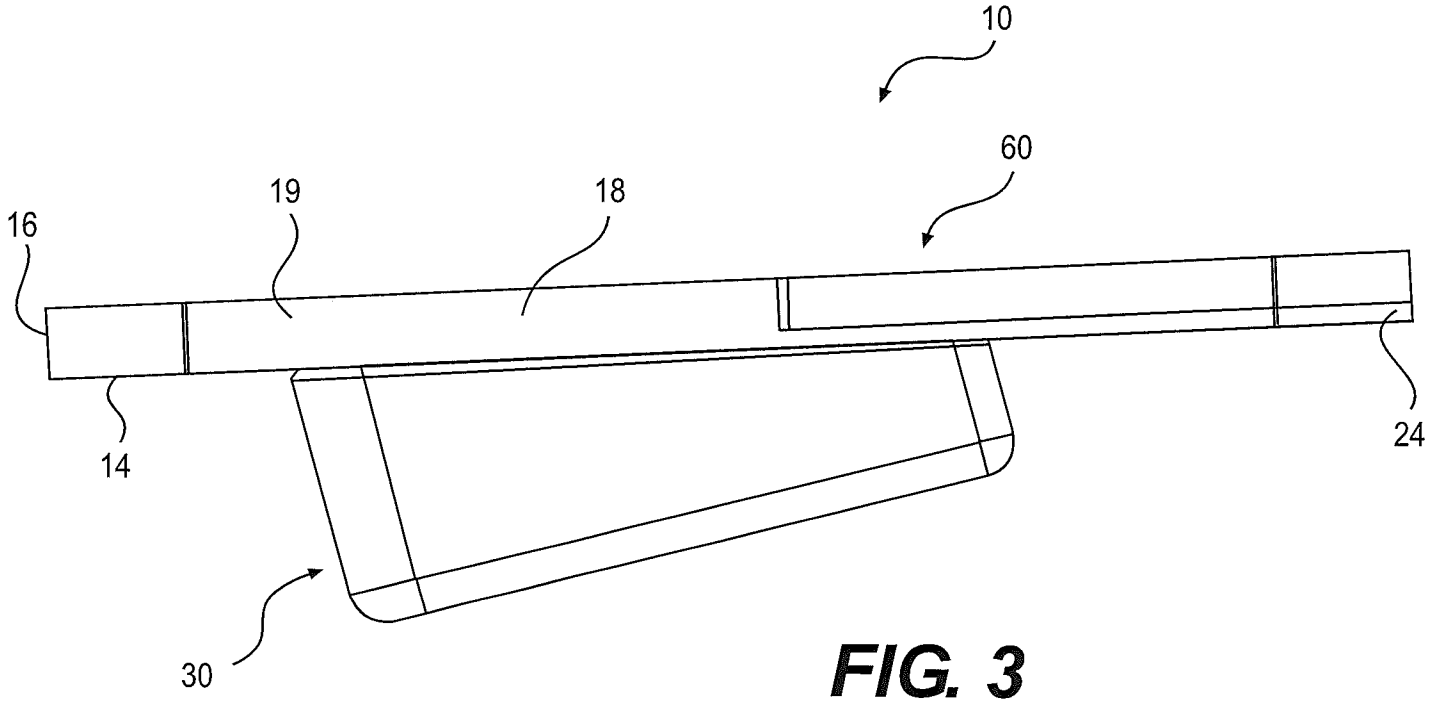
FIG. 3 is a side elevational view of the work support of FIG. 1 showing a partially inflated bottom support.

FIGS. 2 and 3 show the work support and a liner 100 along with a depending positioning pillow 30, and as shown in FIG. 2 that positing pillow 30 is partially inflated and it is fully inflated in FIG. 3.

FIG. 1 shows that the U-shaped raised member 13 and the side members 15 and 17 define there within a well area 24 that will receive an upper portion of the liner 100. The well area 24 is surrounded by the raised sides 15, 17 and 19 in order to keep a keyboard, as is shown at 50, or a mouse or pointed 52 from sliding off the support 10.

The work supports or trays 10 or 10-1 can be constructed using a variety of approaches. For example it could be formed from a laminated structure that is cut into a desired shape. Alternatively, for example, it could be molded from a moldable material including plastic materials, thermoplastics, synthetic or semi-synthetic resins, organic resins, polymers, polyamides, polyolefin, polyurethanes, polycarbonates, polystyrene, compressed wood fibers, wood, medium density fiberboard, metal, or other man made materials or combinations of materials. The lower portion, which will provide a resting area for a user's forearms, can be left uncovered, or provided with an upper or outer surface of fabric, or an antifriction material, or of a metal or soft foam.

Figure 5:
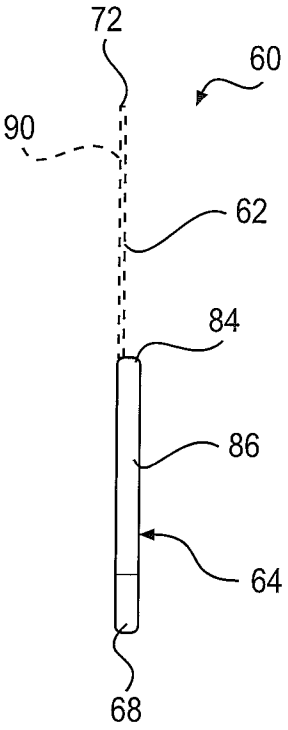
FIG. 5 is a side elevational view of the liner of FIG. 4.
Figure 4:
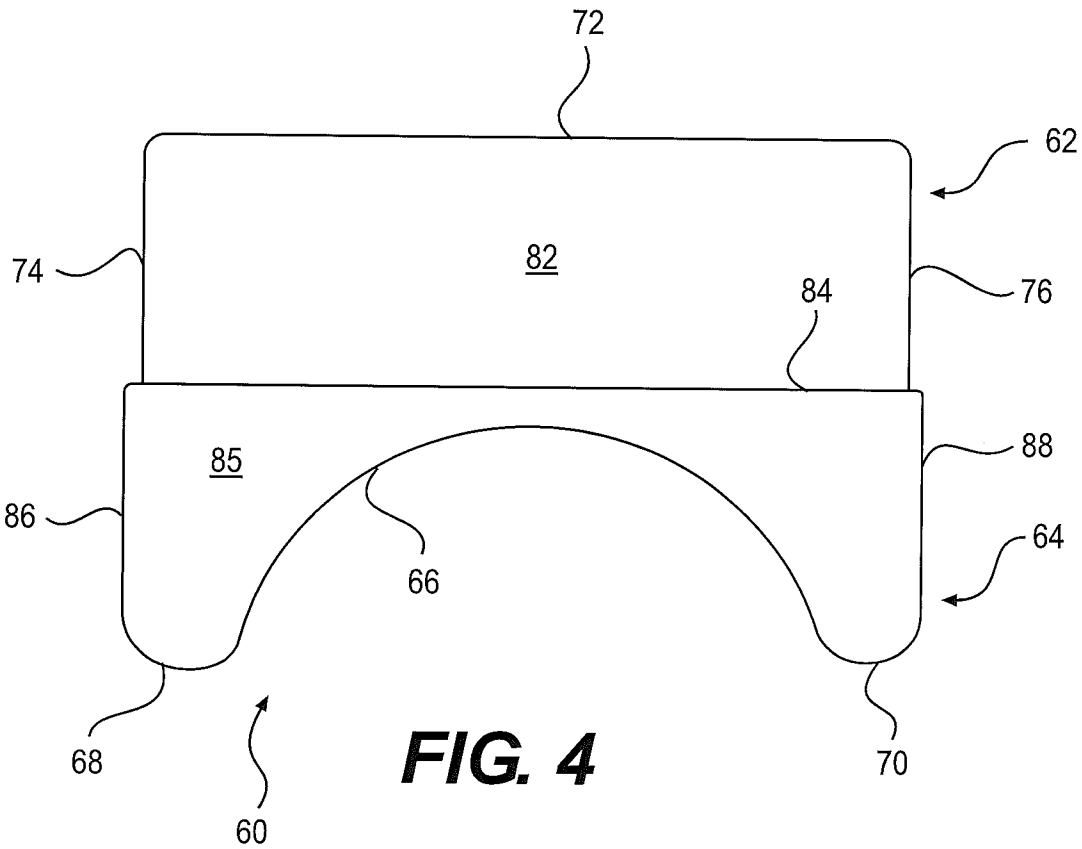
FIG. 4 shows a top plan view of a molded liner for use with the work support.

FIGS. 4 and 5 show a liner for use with the work support of the present invention and is generally shown at 60 and includes a top section 62 that is comprised of an exposed surface 82 and a lower portion 64, that also has an exposed top surface 85, includes a curved bottom edge 66 and projections 68 and 70 that are encompassed within bottom edge 66. Here the top section 62 has a top edge 72 and right and left side edges 74 and 76, respectively, that are inset from the outer boundary established by side edges 86 and 88 of the lower portion 64. The lower portion 64 has a top surface 85 that is raised relative to the exposed surface 82 of the top section thereby forming a raised edge 84 that defines a lower end for the top section 62.

The liner 60 is preferably a molded, one piece element and can be fabricated from a soft molded material, for example, a foam, polyurethane foam, self skinning foams, or other soft plastic material. It is also possible to include a fabric as the exposed surfaces 82 and 85, or surfaces 82/85 could be formed from an anti-friction material, for example a rubber or soft plastic layer, or that material could be an over laid surface as shown in phantom at 90 in FIG. 5.

Figure 15:
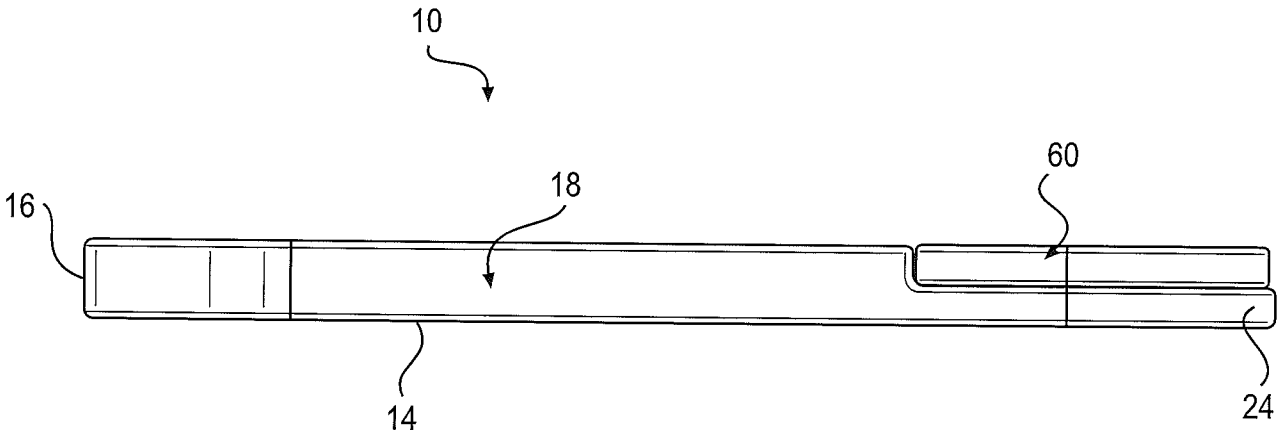
FIG. 15 is a side elevational of a work support or tray without a positioning pillow but with a liner in place.
Figure 16:
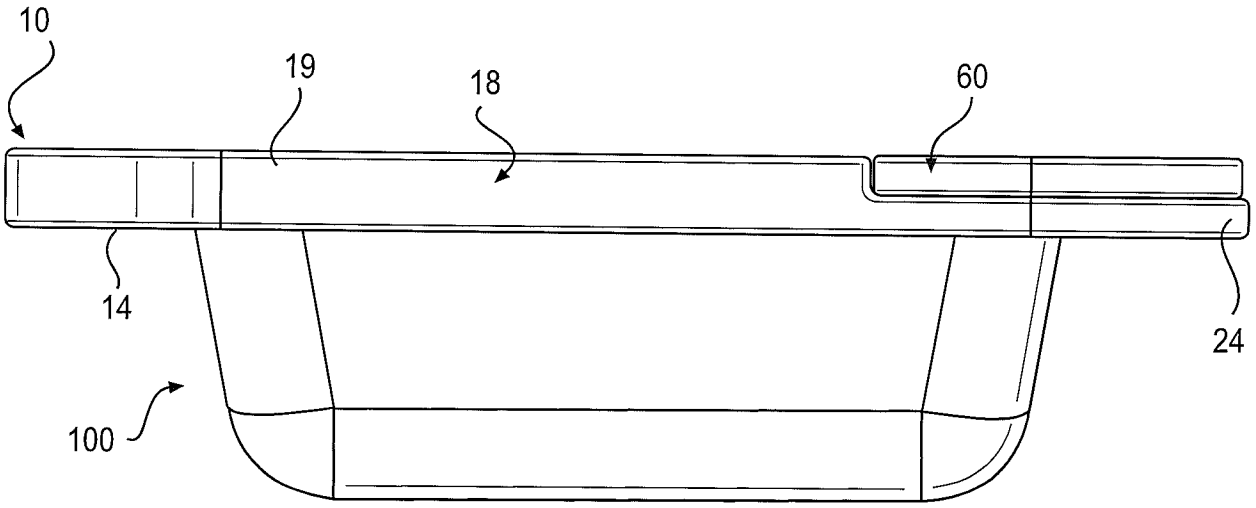
FIG. 16 is a side elevational of a work support or tray with a positioning pillow inflated and with a liner in place.

FIG. 15 shows the work support or tray 10 having a liner 60 positioned within the work support and this tray does not include a positioning pillow connected to the bottom of the work support or tray. FIG. 16 shows a work support or tray but with a positioning pillow 100 attached to the bottom of the work support and in an inflated condition.

FIG. 6 shows a positioning pillow, generally shown at 100, for use with the work support device 10. The positioning pillow 100 has an uninflated arced inside or proximal wall 102 that mirrors the proximal curve of the work support device 22*a* and is provided with smaller projections 104 and 106 to fit beneath projections 24 and 26. The positioning pillow 100 also has a distal wall 108 and left and right side walls 110 and 112. As discussed more below, the positioning pillow has two chambers, 130 and 132 that are separated from one another and are independently inflatable. Walls 102, 108, 110 and 112 are the outer walls of the lower chamber 132. The positioning pillow 100 also has a top wall 114 and a bottom wall 120, shown in FIG. 7. Two Velcro pads 116 and 118 are affixed, for example, by being adhesively attached at two, spaced apart locations as shown, thereby permitting the positioning pillow 100 to be removably attached to the bottom of the work support device or tray 10 using complementary Velcro pads thereon. It should be understood that the positioning pillow 100 can also be removably attached across the whole of the surface of wall 114 and likewise the whole surface of the work support or tray 10, or the positioning pillow can be permanently affixed to the work support device 10. Velcro strips 116/18 can also be sown or otherwise fixed to wall 114.

FIG. 7 shows a bottom view of the positioning pillow 100 with a plurality of ribs 122 that can be formed, for example, by sewing the ribs onto the bottom wall 120. The ribs or ribbing 122 can also be formed using stiffeners that can be enclosing by fabric and suitable sewing to enclose the stiffeners therein. The ribbing 122 will extend in a direction parallel to a user's thighs and provide an area for some amount of ventilation or air flow between the bottom wall 120 and the user.

As discussed above, the positioning pillow 100 has upper and lower chambers 130 and 132, respectively, as shown in FIG. 10, and either can be inflated meaning that only one of the two can be inflated, or the two chambers can each be partially inflated. The lower chamber can also be filled from about one quarter to being fully filled with foam beads, for example polystyrene beads, yet still have room for inflating fluid to be added therein as well, preferably air. FIG. 8 shows a side view of the lower chamber 132 of the positioning pillow 100 in a partially inflated condition. The side wall 110 includes a closeable polystyrene bead inlet 124, as well as a bottom air inlet 126 to which can be attached a hose for manual filling or an outlet nozzle from a suitable air pump, (not shown).

FIG. 9 shows the same side view of the positioning pillow as was shown in FIG. 8, but here both chambers 130 and 132 of the positioning pillow 100 are fully inflated. This figure also shows second and separate air inlet 128 for the upper air chamber 130 as well as a proximal wall 134 and a distal wall 136. Both proximal walls 102 and 134 can be about two inches high, and distal wall 108 can have a height of about four inches and distal wall 136 can have a fully inflated height of about 6 inches. Thus, the front or proximal wall area can have an inflated height of about four inches and a combined distal wall height of about ten inches. It should be understood that these dimensions are exemplary and can be varied for different users, and can have other wall heights. For example, the combined height of the proximal walls 102 and 134 could vary from one inch to about six inches, and the rear or distal walls 108 and 136 could have a combined height ranging from about four to about eighteen inches.

Much of the medical research of today focused on ergonomics, human-computer interaction and the resultant musculoskeletal disorders (MSD's) biomechanically inefficient posture can provoke, advocate for a separation of the computer monitor from the keyboard and pointing device to allow for less orthopedically stressful wrist, elbow, shoulder, neck, middle, and low back angles. It is important to note that the primary purpose in combining an attached footrest and detached keyboard tray is that, together, these components most easily facilitate the sitter's separation of computer screen or monitor from keyboard and pointing device, and the sitter's resultant high degree of biomechanically neutral posture while interacting with their devices of choice in addition to all the leg muscle activation benefits that having an attached footrest provides.

If a sitter is using the attached footrest, for example, but keyboarding on a keyboard tray located anywhere but in the general vicinity of their lap, then studies have shown that they will forego comfort and neutral posture to lean forward/hunch over to reach their keyboard and pointing device. Or, if a seated computer user places their laptop on their lap to work, thereby NOT separating keyboard from monitor, then the resultant excessive neck flexion (downward neck bending) to see the screen will cause neck pain and pathology, such as "text neck", over time.

If a sitter is holding their computer tablet in-hand, again, not separating their monitor from keyboard, then the resultant posture can include excessive neck flexion, in addition to excessive neck rotation or twisting, depending on how the user is holding the device, and in which hand. This combining of excessive neck flexion and rotation has shown to significantly accelerate degenerative processes at the neck and upper extremities. Thus, it is simple to understand the physiological need for chronic computer users to habitualize the practice of separating the monitor from the keyboard and pointing device, as much as possible, as soon as chronic computer use occurs in one's life, which is happening far sooner in the life cycle of children born in industrialized nations today.

At minimum, to achieve a biomechanically neutral position while interacting with a computer, the most important feature is to have the keyboard and pointing device separated from the monitor, and to have the detached keyboard tray in the general vicinity of one's lap. The monitor/computer screen can be placed one arm's length away from the users eye's, with minimal neck bending, by a host of conventional means including, but not limited to, a standard or height adjustable notebook/monitor/tablet riser, a stack of books or reams of paper, or by simply placing the screen or monitor atop a static or height adjustable table. Most recently in office settings, articulating monitor arms are the tool of choice for correct monitor height and proximity to the seated user.

Thus, some degree of biomechanically neutral posture and comfort can be achieved with the detached keyboard tray, alone. However, optimal biomechanically neutral positioning while seated using a computer is best achieved when the detached keyboard tray is used in conjunction with the attached footrest designed to increase leg muscle activation and the time spent in neutral by physiological means and methods described elsewhere in this application.

Thus, by placing the keyboard tray in the right place for the user to keep their feet on the attached, tension resisting footrest, while remaining in overall neutral postural angles from the feet and upwards, the sitter's capacity to contract the large postural support muscles in the legs while seated, including the glutes and quads, has also proven to produce a suite of beneficial biochemical molecules. Most notably, the activation of these muscles activates an enzyme called lipoprotein lipase, which acts as a virtual vacuum cleaner for fats in the blood stream. When these muscles remain inactive for too long by virtue of, for example, prolonged sitting without breaks, even in neutral, lipoprotein lipase activity becomes virtually nonexistent, eliminating the body's ability of their muscles to remove noxious fats from the bloodstream, as well as a significant decrease in HDL cholesterol, aka the "good" cholesterol. In fact, research has shown that just a few hours of sitting without breaks suppresses a gene that helps keep your cardiovascular system healthy by controlling inflammation and blood clotting. Research has shown that after just one day of sitting, exercise does not turn the gene back on, even for runners. What has shown to turn this gene back on for sitters is periodic and routine breaks from sitting.

Thus, leg muscle activation and biomechanically neutral posture while seated does not exclude the sitter's requirement to takes frequent breaks from sitting to help decelerate the degenerative effects and disorders prolonged sitting can create in other systems of the human body besides just the musculoskeletal. Studies have found that simply interrupting one's sitting time with short breaks of just standing, pacing or walking slowly has beneficial effects. Pinpointing just exactly how long or frequent these breaks need to be is still up for investigation. More recent research show signs of improved glucose metabolism with 1 minute and 40 seconds of pacing every 30 minutes, for a nine-hour sitting period, as well as 2 minute bouts of light intensity walking every 20 minutes throughout a five-hour sitting period. In short, getting up and either standing or walking around for about two minutes at least twice per hour can help keep your skeletal muscles turned on and lower the risk of disease. A battery operated timer or alarm can help acclimate sitters to the frequency and duration of required rest breaks for more healthful, and less detrimental prolonged interaction with their computers and other electronic devices.

Figure 17:
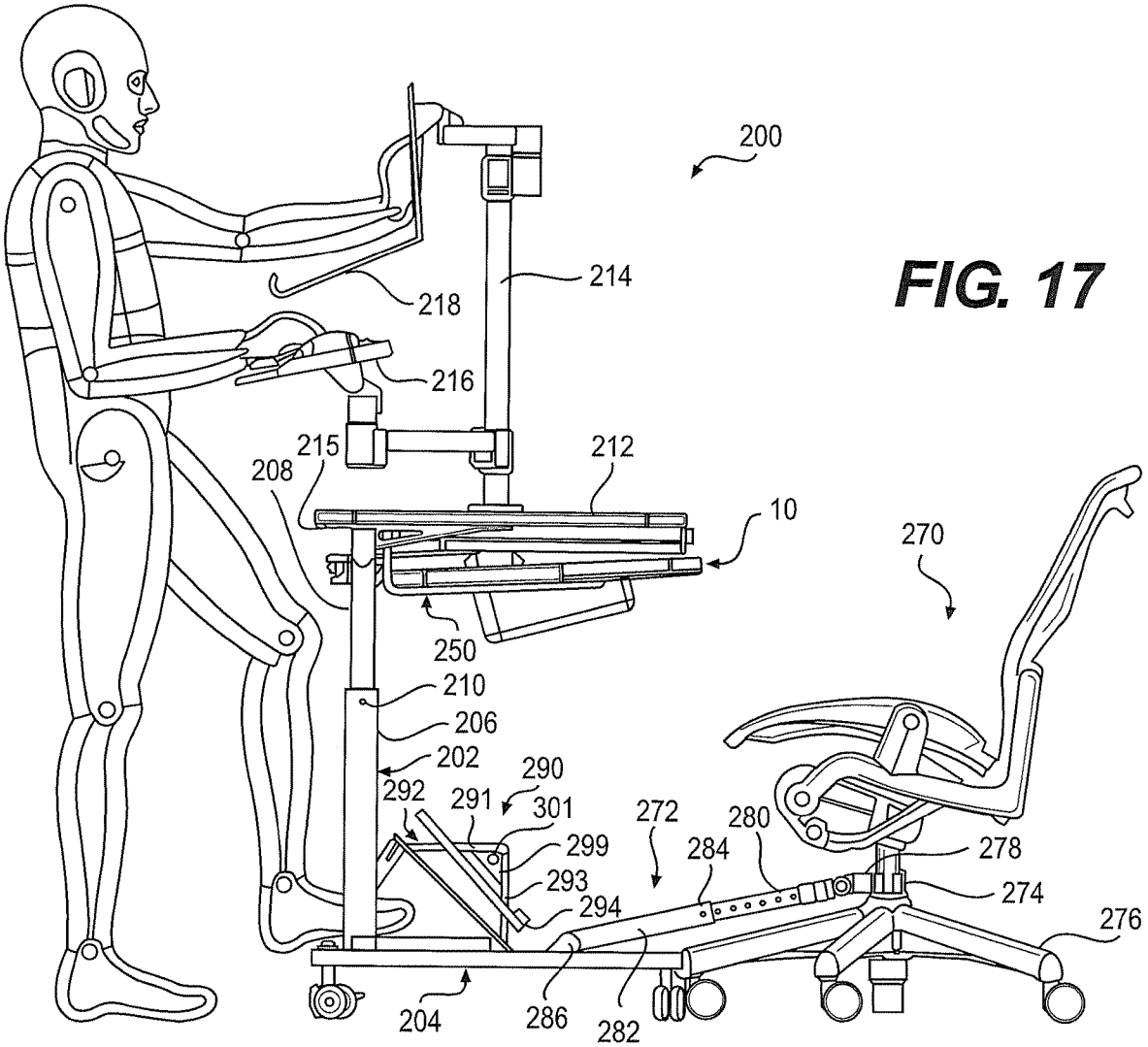
FIG. 17 is a diagrammatic view of an individual standing at a work station showing the work support device removably stored in a mounted tray rack.

With reference to FIGS. 11-13 and 17, FIGS. 11-13 show a mounting rack 250 for removably holding a work support device, for example as shown at 10 in FIG. 1, within a work station 200 shown in FIG. 17. Work station 200 in FIG. 17 includes a main stand 202 having a base 204, a vertical upright 206 into which a smaller vertical section 208 slidingly fits and is height adjustable within upright 206 by a removable pin 210. A horizontal support 212 is connected to and supported by the 4 vertical section 208 and separately supports an upright member 214 which, in turn, supports a keyboard tray 216 and a support 218.

Figure 11:
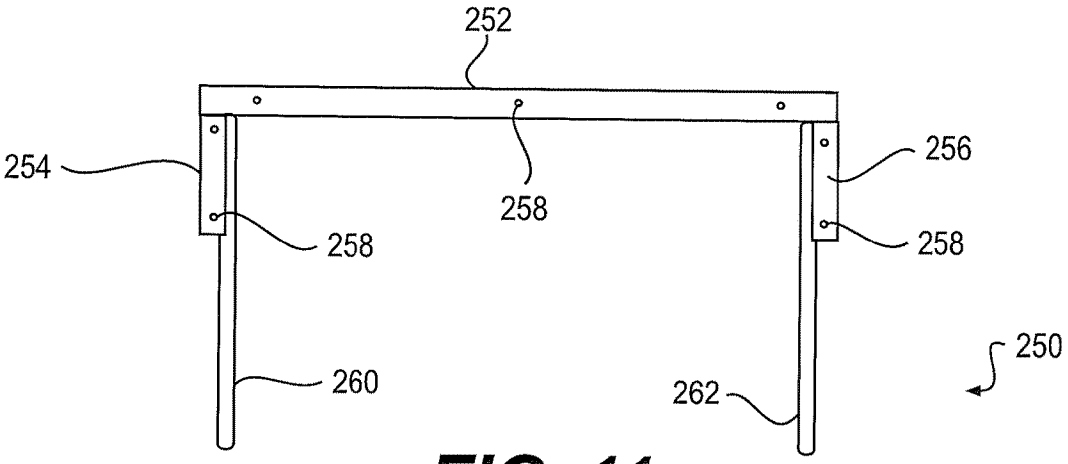
FIG. 11 is a diagrammatic view of a truss bridge and supports therefor under load.
Figure 13:
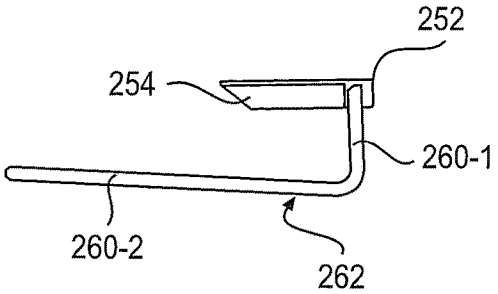
FIG. 13 is a cross sectional view taken along line 13-13 in FIG. 12.
Figure 12:
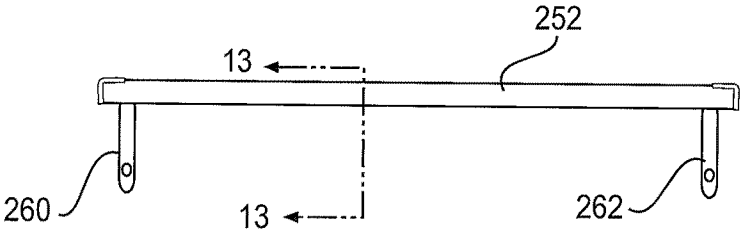
FIG. 12 is a front elevational view of the storage rack of FIG. 11.

Turning to FIGS. 11-13 tray rack 250 includes a rear support 252 having welded at each end a separate side supports 254 and 256. Each of supports 252-256 include a plurality of holes 258 permitting the rack 250 to be mounted. A pair of L-shaped supports 260 and 262 are secured at opposite ends of the rear support 252, for example by welding, and to one of the side supports 254/256, again for example, by welding, by suitable adhesives or by a suitable mechanical system of screws or bolts (not shown). The side supports 254/256 can be about six inches long, the rear support 252 can be about 24 inches long and the L-shaped supports can have a length of about 13-15 inches and can have a rear depth or drop for rear support 252 of about 3-5 inches. It is also preferred if the angle between the rear vertical portion 260-1 of the L-shaped supports 260/262 and the forwardly extending portion 260-2 is at an acute angle of about 89-80 degrees, with the preferred angle being about 87 degrees.

FIG. 14 also shows the tray rack 250 being mounted at a rear part of a bottom surface 215 of the horizontal support 212 by means of the rear support 252 and the side supports 254/256 being secured as by screws (not shown). As is also shown in FIG. 14 the work support device 10 has been slid into the rack 250 and is being supported by the L-shaped side supports 260/262.

Figure 20:
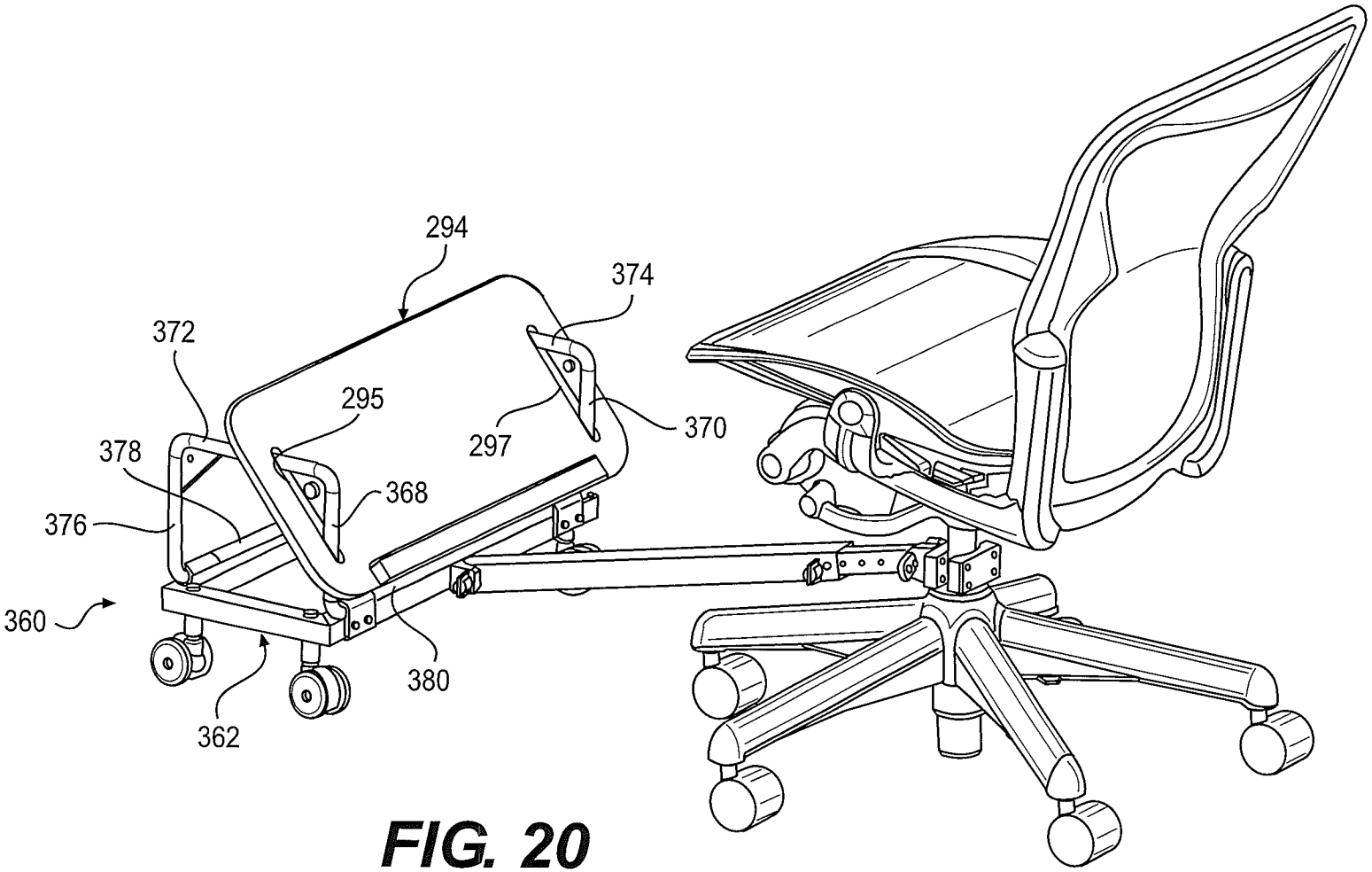
FIG. 20 is a perspective view of a chair and a tethered foot rest.

FIG. 17 additionally shows a chair 270 that is tethered by an adjustable rail system 272 to the work station base 204. The rail system 272 includes a securing collar 274 attached to the chair base 276 and a pivotal connection 278 onto which a member 280 is movably secured. Member 280 slidingly fits into a second member 282 and is secured in a desired position therein by, for example, a pin 284. An opposite end of member 282 is movably secured to the work station base 204 by a pivot connection 286. A foot rest 290 is attached to the work station base 204 and includes a frame 292 and a foot rest plate 294. Frame 292 includes two spaced apart frames each having an upper bar member 291, a front vertical bar member 293 and a rear vertical bar member (not shown). The foot rest plate 294 includes two slots 295 and 297, as shown in FIG. 20, and those slots 295/297 will slide along and move about the top bar 291 and the front bars 293 so that the foot rest plate 294 can articulate to accommodate a user's foot movement. To help hold the foot rest plate 294 on the frame 292 a metal bracket 299 is welded or attached at the corner of the upper bar 291 and the front bar 293 which supports a rubber bumper 301 that is slightly longer than the width of the slots 295/297. Those slots can be pushed over the bumpers 301 and then the bumpers 301 will assist in holding the foot rest plate 294 on the frame 292 yet not impede the articulation motion that is desired.

Figure 18:
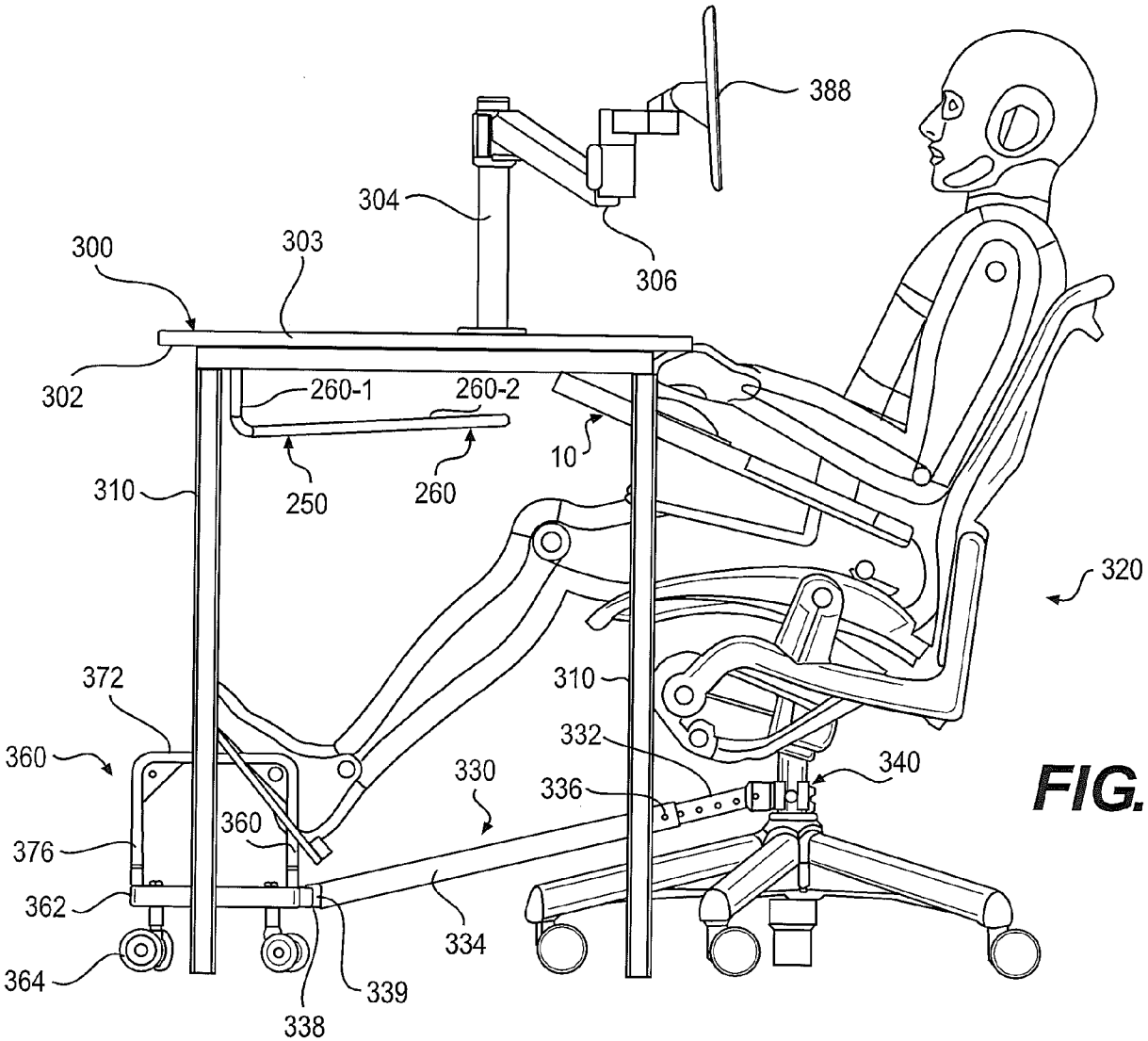
FIG. 18 is a diagrammatic view of a work table having a tray rack mounted there below and showing a separate tethered chair and foot support with the seated user having the work support in a desired lap position and a positioning pillow in a partially inflated condition.

FIGS. 18 and 20 show another embodiment and here the tray rack 250 is mounted to a bottom surface 302 of a top 3003 of a worktable 300. The worktable 300 includes an upright support 304 that is connected to the top 303 and holds a movable arm 306 that supports a monitor screen 308. That upright support 304 could also be a monitor riser for laptops, netbooks, tablets or other hand held devices. Worktable 300 also can have legs 310 secured thereto to position the top 303 at a desired height. The chair 320 is similar to that described in FIG. 17, but here the tether assembly 330 includes a chair connection 340. The tether assembly 330 includes a first rail member 332 that is slidingly received within a second rail member 334 and a pin connection 336 provides a way to adjust the relative position there between. Proximal end of rail member 332 is pivotally secured to the chair connection 340 and an opposite end of member 334 is pivotally connected to a bracket 338 provided on a roller member 360 by a pin 339.

The roller member 360 has a base frame 362 onto which four wheels or casters 364 are suitable attached. An upstanding frame 366 includes front vertical bars 368 and 370, top bars 372 and 374, and rear vertical bars 376, only one of which is shown. There can also be cross bars, for example as shown at 378 for a rear bar that would extend between the bottoms of rear bars 376, and a front cross bar 380 that would extend between front bars 368 and 370. An adjustable foot rest 294 that can be positioned at a variety of angles on frame 362 as it was in the FIG. 17 embodiment as the foot rest plate 294 will be the same. The slots 295/297 can have an anti-slip coating applied there within or the slots could be provided with a brush member on each inwardly facing surfaces, and either the coating or the brushes will interact with the top and front bars to provide some resist ace to a user in positioning the angle of the footrest plate 294.

Figure 19:
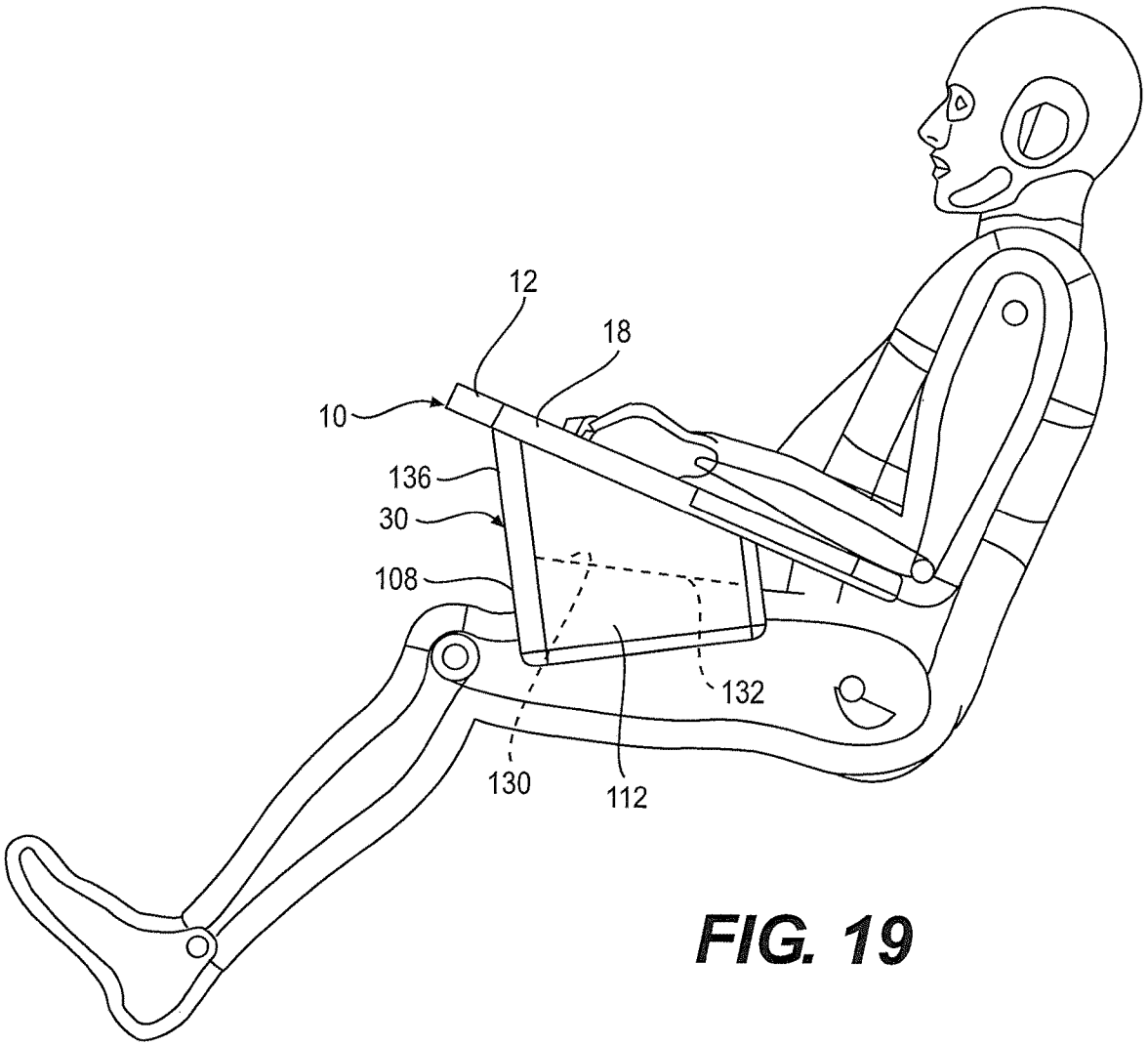
FIG. 19 is a diagrammatic view of a seated user employing the work support device with the positioning pillow fully inflated.

FIG. 18 also shows the portable work support device 10 in a detached or unracked form, having been slid out of tray rack 250 and is being used by a seated user so that the inflated supports 30 are resting on the users legs and supporting the users arms FIG. 19 shows the portable work support device 10 being used in a manner that the inflatable bottom supports are fully inflated and provide a dynamic support for a keyboard or work that permits the seated user to remain in a fully back position in a reclining chair, as sown at 270 in FIGS. 14 and 15.

Figure 21:
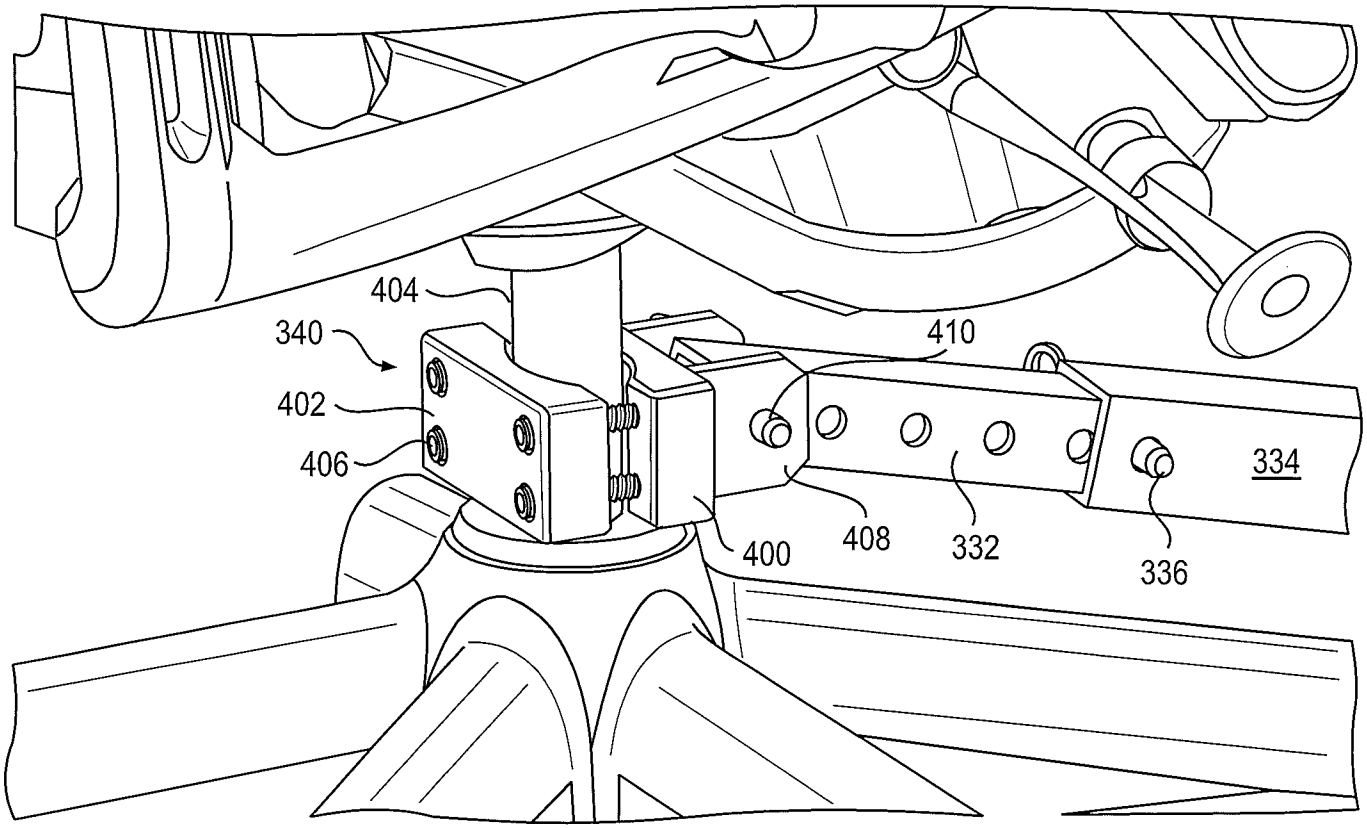
FIG. 21 is a detailed rear perspective view of the tether to chair connection.
Figure 22:
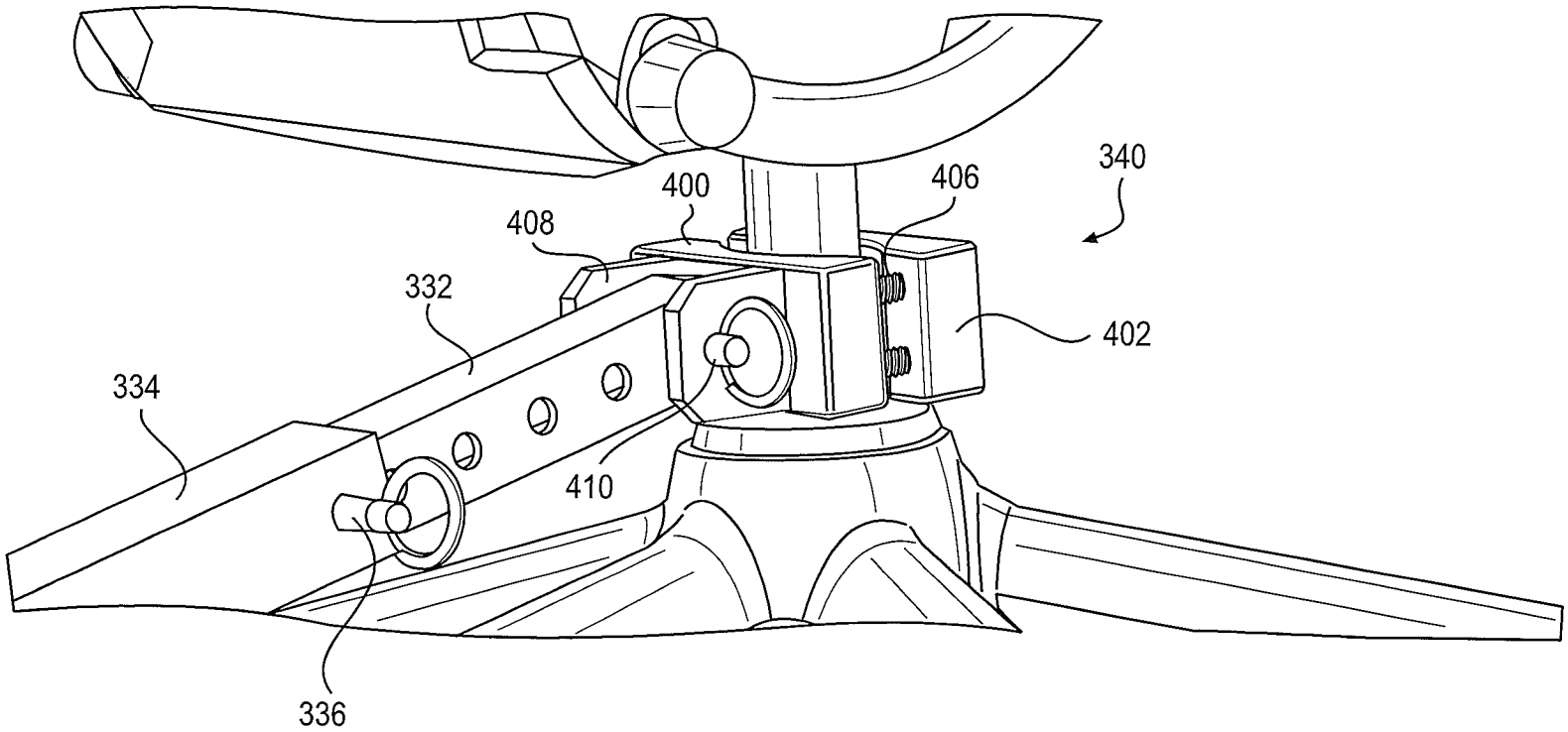
FIG. 22 is a detailed front perspective view of the tether to chair connection.
Figure 23:
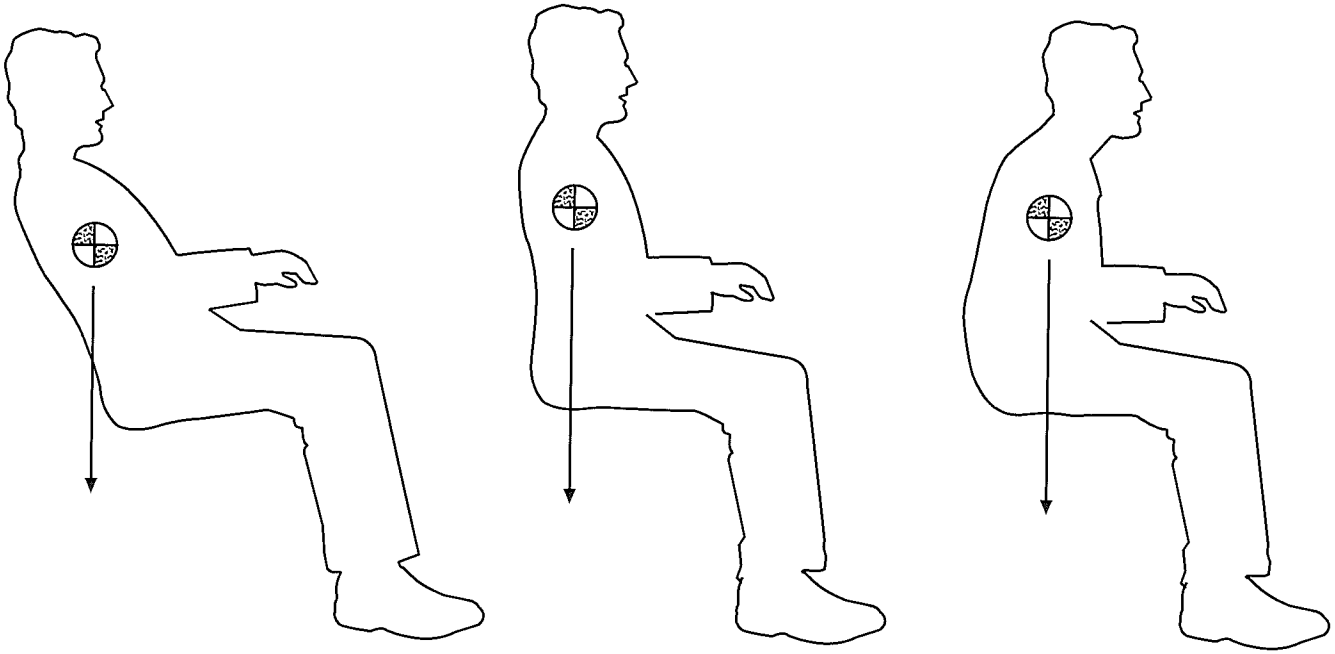
FIG. 23 is a showing of three possible user postures.

FIGS. 21 and 22 show a more detailed view of the chair connection 340 as being comprised of front and rear mounting blocks 400 and 402, that are held together and adjustably connectable to a vertical upright 404 of a chair by screws 406. The front block 400 includes a bracket 408 and a connecting pin 410 that pivotally holds rail member 332 thereto.

When introducing elements of various aspects of the present invention or embodiments thereof, the articles "a," "an," "the" and "said" are intended to mean that there are one or more of the elements, unless stated otherwise. The terms "comprising," "including" and "having," and their derivatives, are intended to be open-ended terms that specify the presence of the stated features, elements, components, groups, and/or steps, but do not exclude the presence of other unstated features, elements, components, groups, and/or steps and mean that there may be additional features, elements, components, groups, and/or steps other than those listed. Moreover, the use of "top" and "bottom," "front" and "rear," "above," and "below" and variations thereof and other terms of orientation are made for convenience, but does not require any particular orientation of the components. The terms of degree such as "substantially," "about" and "approximate," and any derivatives, as used herein mean a reasonable amount of deviation of the modified term such that the end result is not significantly changed. For example, these terms can be construed as including a deviation of at least +/−5% of the modified term if this deviation would not negate the meaning of the word it modifies.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A neutral posture inducing work station and chair which together promote a desired reclined sitting and work position in the chair and to achieve a reclined biomechanically neutral posture therein, comprising:

a work station having a main support comprising a base frame, a supporting surface, a monitor support;

a retaining fixture attached to said main support, said chair having a seat and back that together are tiltable to a reclined position and adjustably connected to a foot support member so that an individual sitting in the chair can be provided with support to establish a desired level of foot and pelvis triangulation to achieve and maintain the desired neutral posture; and a portable, lap supported work support tray removably retained by said retaining fixture, said portable, lap supported work support tray for use by a work station user while seated in the tiltable chair in a reclined, neutral posture position aided by the foot support, said portable, lap supported work support tray comprised of an upper member having a top surface for receiving a detached keyboard, a mouse or work, and a proximal portion including a proximal edge having an inwardly curved portion, and a lap conforming member secured to a bottom surface of the upper member to provide dynamic support for the detached keyboard, mouse or work so that when in use on a seated user's lap the portable, lap supported work support tray will induce, promote and maintain a neutral posture for that seated user;

the position of the chair relative to the work station being adjustable to permit the seated user to use the work station.

2. The neutral posture inducing work station and chair as in claim 1 wherein the main support includes a bottom surface and the retaining fixture comprises a tray rack fixed to said bottom surface.

3. The neutral posture inducing work station and chair as in claim 1 wherein the tray rack comprises an open frame having a forward facing opening and a width thereof to removably receive and store the portable lap supported work support tray therein.

4. The neutral posture inducing work station and chair as in claim 1 wherein the reclined position comprises a tilt angle ranging from 10° to 45°.

5. A neutral posture inducing work station including a chair having a seat and back that together are tiltable to a reclined position and is adjustably tethered to a foot support which collectively promote a desired reclined sitting position for a seated user to be positioned fully back in the chair establish a desired level of foot and pelvis triangulation to achieve and maintain a biomechanically reclined neutral posture, comprising:

a work station having a work surface supported by a plurality of legs;

and a portable, lap supported work support tray for use by a seated work station user while seated in a reclined, biomechanically neutral posture position, the portable, lap supported work support tray comprised of a lap conforming base and an upper surface provided with a recessed area for receiving a detached keyboard, a mouse or work, and a proximal portion including a proximal edge having an inwardly curved portion, the lap conforming base providing dynamic support for the detached keyboard, mouse or work so that when in use on the seated user's lap the portable lap supported work support tray will induce, promote and maintain a neutral posture for that seated user; and a tray rack fixed to the work station and comprised of an open frame secured to a bottom part of the work surface and having a forward facing opening spanning a width thereof for removably receiving and storing the portable lap supported work support tray therein;

the position of the chair relative to the work station being adjustable to permit the seated user to use the work station.

6. The neutral posture inducing work station and chair as in claim 5 wherein the reclined position comprises a tilt angle ranging from 10° to 45°.

7. A neutral posture inducing work station, lap desk and chair which together promote a reclined sitting and work position for a work station user in the chair and to achieve a reclined biomechanically neutral posture therein, comprising:

a work station having a main support comprising a base frame, a supporting surface, a monitor support;

said chair having a seat and back that together are tiltable to a reclined position and adjustably connected to a foot support member so that an individual sitting in the chair can be provided with support to establish a desired level of foot and pelvis triangulation to achieve and maintain the desired neutral posture position in the chair; and a lap supported work support tray for use by a work station user while seated in the tiltable chair in a reclined, neutral posture position aided by the foot support, said lap supported work support tray having a top surface for receiving a detached keyboard, a mouse or work, and a proximal edge having an inwardly curved portion, and a lap conforming member secured to a bottom surface of the support tray to provide dynamic support for the detached keyboard, mouse or work, so that when in use on a seated user's lap the lap supported work support tray will induce, promote and maintain the neutral posture position for that seated user;

the position of the chair relative to the work station being adjustable.

* * * * *